US006619662B2

(12) United States Patent
Miller

(10) Patent No.: US 6,619,662 B2
(45) Date of Patent: Sep. 16, 2003

(54) WAGER SENSOR AND SYSTEM THEREOF

(75) Inventor: John Raymond Miller, Tucson, AZ (US)

(73) Assignee: Gold Coin Gaming Inc., Tucson, AZ (US)

( * ) Notice: Subject to any disclaimer, the term of this patent is extended or adjusted under 35 U.S.C. 154(b) by 0 days.

(21) Appl. No.: 10/059,955

(22) Filed: Nov. 26, 2001

(65) Prior Publication Data

US 2002/0089120 A1 Jul. 11, 2002

Related U.S. Application Data

(63) Continuation of application No. 09/457,636, filed on Dec. 8, 1999.

(51) Int. Cl.[7] ..... A63F 3/08

(52) U.S. Cl. ..... 273/274; 273/148 R; 273/237; 273/309; 273/292; 463/25; 463/27; 463/29

(58) Field of Search ..... 273/274, 309, 273/292; 324/66; 463/25, 27, 29, 138.2, 138.1, 139

(56) References Cited

U.S. PATENT DOCUMENTS 5,619,128 A * 4/1997 Heger ..... 324/202
5,909,876 A * 6/1999 Brown ..... 273/309
5,924,926 A * 7/1999 Brown ..... 273/292
5,961,121 A * 10/1999 Brown ..... 273/148 R
6,070,878 A * 6/2000 Jones et al. ..... 273/292
6,073,930 A * 6/2000 Jones et al. ..... 273/292
6,154,131 A * 11/2000 Jones et al. ..... 273/138.1

* cited by examiner

*Primary Examiner*—Benjamin H. Layno
*Assistant Examiner*—Dolores R. Collins
(74) *Attorney, Agent, or Firm*—Mark Ogram

(57) ABSTRACT

A wager sensor which is employed on the bottom of a gaming table. The sensor identifies when a wager has been placed on the top surface above the sensor and communicates a signal of this occurrence to a controlling computer which monitors the flow of the game. Ideally a number of tables are equipped with the sensors and a single controlling computer is then able to monitor the operation of the entire assembly.

14 Claims, 8 Drawing Sheets

FIG. 1C
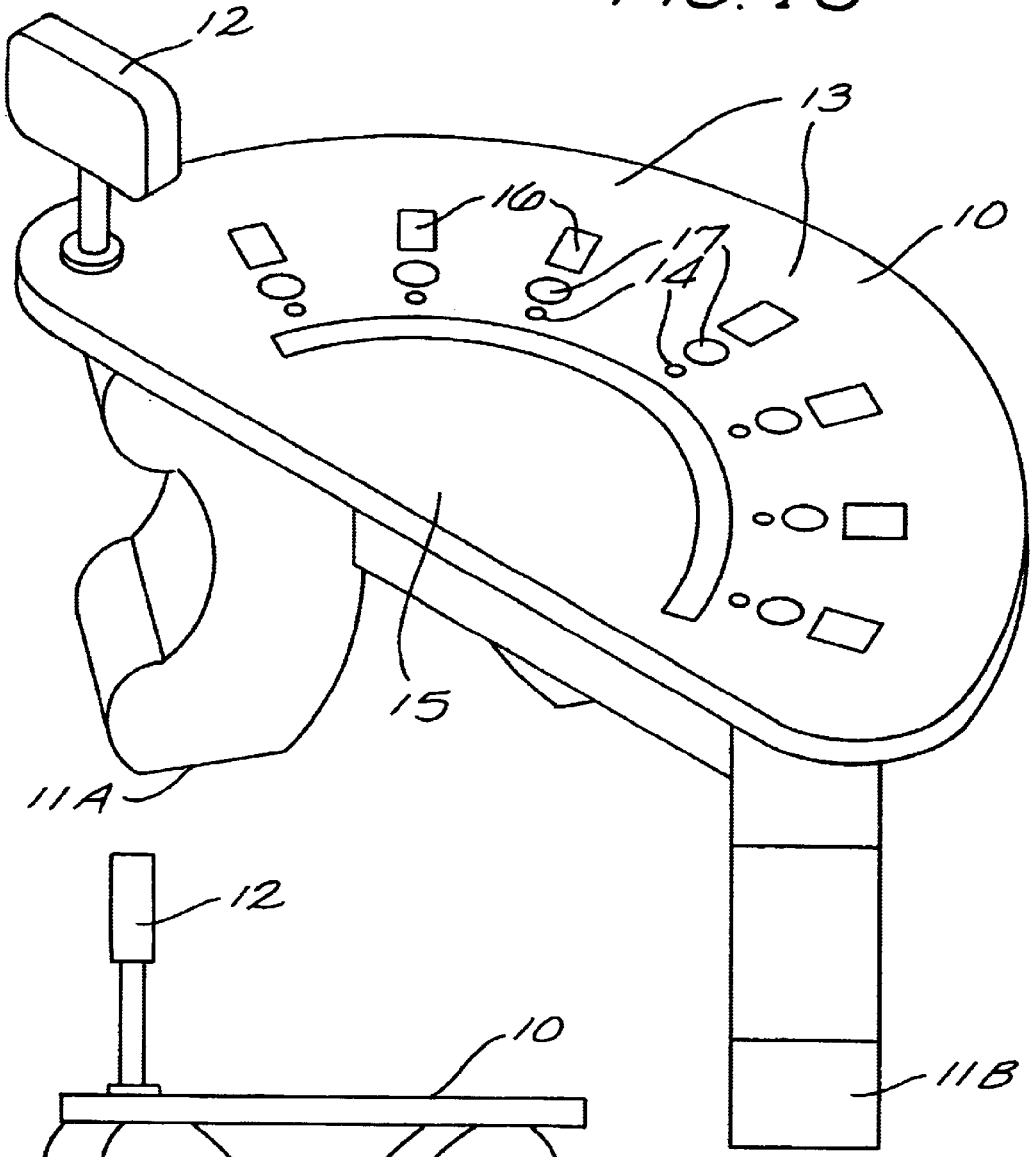
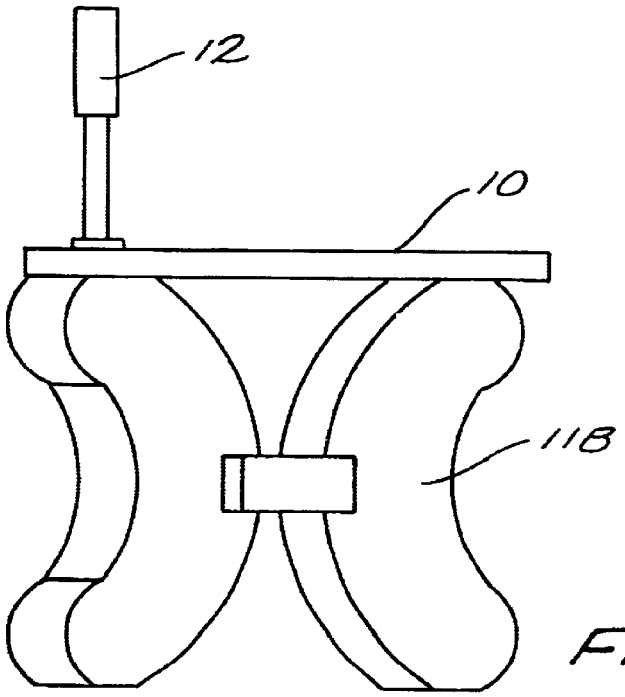
FIG. 1D

WAGER SENSOR AND SYSTEM THEREOF

This is a continuation of U.S. patent application Ser. No. 09/457,636, filed on Dec. 8, 1999 now abandoned, and originally entitled "Through Table Wager Sensing".

BACKGROUND OF THE INVENTION

This invention relates generally to gaming and more particularly to gaming tables and systems with sensors which automatically identify when a wager has been placed.

Gaming throughout the United States has spread because of people's interest in, and the entertainment provided by, the games being played.

For a variety of gaming operations, such as black jack, Poker, Roulette, Pai Gow, Baccarat, O Craps, Crapjack and other games, there is a need to identify the placement of a bet. If metallic coins are used, their presence on a betting location can be ascertained through the use of magnetic sensors or the like; but, the vast majority of gaming institutions use chips which do not contain any metallic elements, or not enough metallic elements, to be sensed by this technique.

Without the ability to automatically determine if a bet has been placed, the automation of almost any wagering operation is frustrated and still requires the use of an extraordinary amount of time from the human dealer.

It is clear that there is a significant need for providing automatic process to facilitate the games themselves.

SUMMARY OF THE INVENTION

The present invention provides for a playing table which identifies when a wager has been placed on an appointed location. The sensor, mounted onto the underside of the gaming table, monitors the mass above it; when this mass is changed (indicating the placement of a wager), then the sensor communicates a signal to a computer.

The sensor of this invention uses a change in capacitive loading of plates to identify this change in mass. One such apparatus is described in U.S. Pat. No. 5,619,128, issued to Heger on Apr. 8, 1997, and entitled, "Stud Sensor with Over-Stud Miscalibration via Circuit Which Stores an Initial Calibration Density, Compares that to a Current Test Density and Outputs Result via Indicator", incorporated hereinto by reference.

The computer uses the signal from the sensor to determine if a wager has been placed in the designated betting position for each player. In the preferred embodiment, each table has an operator/dealer station which includes a display of the status of the wagers and the payoff amounts.

Further, in embodiments of the invention, the operator/dealer station includes an input apparatus allowing the operator/dealer to notify the table computer of the "start-of-game" (thereby not allowing best to be placed) and "end-of-game" (after the prior game's winnings have been paid and when new wagers will be accepted).

In some applications, the gaming table is too thick to permit the retrofitting of the sensor and still obtain the desired sensor sensitivity. In this case, recesses in the underside of the gaming table allow the sensor to be moved closer to the top of the table to obtain the sensitivity sought.

Note though that the top of the table is left undisturbed as the sensor never extends above the top of the table.

In some embodiments of the invention, a light is positioned proximate to the wager location allowing the computer to "notify" the player that the wager has been accepted and logged into the game.

Some embodiments of the invention obtain a sensitivity which allows the sensor to determine how many chips have been placed into the wager location. The number of chips determines a state for the sensor which is also communicated to the computer. This embodiment is particularly advantageous when multiple chips are allowed to be bet on the game.

More specifically, the presence sensor of this invention is able to detect a chip, token, coin, marker or any object used in any form of gambling, game playing or wagering. The sensor detects the presence of the object when the object is placed on the playing surface (i.e. table, board, or any other form of gaming device).

The sensor generates a signal via wired connection, optical coupling, or radio frequency which is used to identify if the object is present or not. The preferred method of identifying a present/not-present state is through the signal strength being transmitted.

Using the sensor of U.S. Pat. No. 5,619,128, as described above (and commercially available from the Zircom Corporation), the indication varies according to the size and proximity and molecular density of said object.

Ideally, the microprocessor on the gaming sensor itself communicates via a serial data link to the main controller. This serial data link consists of an RS-232, RS-422, RS-485, optical link, or radio frequency data.

The ideal arrangement is where a multitude of sensors are utilized. In this context, the serial data link is a shared link amongst all sensors. Each sensor has a unique identification number. This enables the main controller to address any individual sensor in the group or the group as a whole.

In the preferred embodiment, the main controller is equipped with a variety of instructions which are employable by the controlling software. These instructions include, but are not limited to: all units reset; all units light on; all units light off; all units sensor on; all units sensor off; addressed unit reset; addressed unit light on; addressed unit light off; addressed unit sensor on; addressed unit sensor off; and addressed unit send sensor data.

In the preferred embodiment, the commands that are addressed by all units are carried out by the individual sensors with no acknowledgment back to the main controller. All addressed unit commands have a reply sent back to the main controller that depicts the status of the given command and its completion.

The microprocessor within the sensor receives commands and executes them. These commands consist of controlling either the sensor chip or indicator light (located on the top of the playing table).

The indicator light is a light that is attached to, the playing surface that is used to signal the player when an object placed in the active sensing area of the playing surface and which has been recognized by the central processor. This light can be any distance from the active area and is controlled by the microprocessor within the sensor in response to commands from the main controller.

In one embodiment of the invention, the sensor chip is powered on/off by the sensor's microprocessor. Through power control sequencing, the sensor's range and capacity is placed in either a low power or high power sensing mode. This change also re-calibrates the sensor to the thickness of the playing surface.

When activated in either the high or low power sensing modes the sensor chip puts out digital signals on 8 pins that indicate the level of the mass of the object it is sensing or any error condition that exists. These 8 signal pins on the sensor chip are connected to an 8 bit input port on the microprocessor. The microprocessor analyzes the digital level the signals coming from the sensor chip. This analysis allows the microprocessor to then determine the presence or lack thereof of any object in on the playing surface or any error that is occurring. This data is converted and sent to the main controller via the serial communication channel.

The invention, together with various embodiments thereof, will be more fully explained by the accompanying drawings and the following description thereof.

DRAWINGS IN BRIEF

FIGS. 1A, 1B, 1C, and 1D are various views of the preferred gaming table of this invention.

Figure 6:
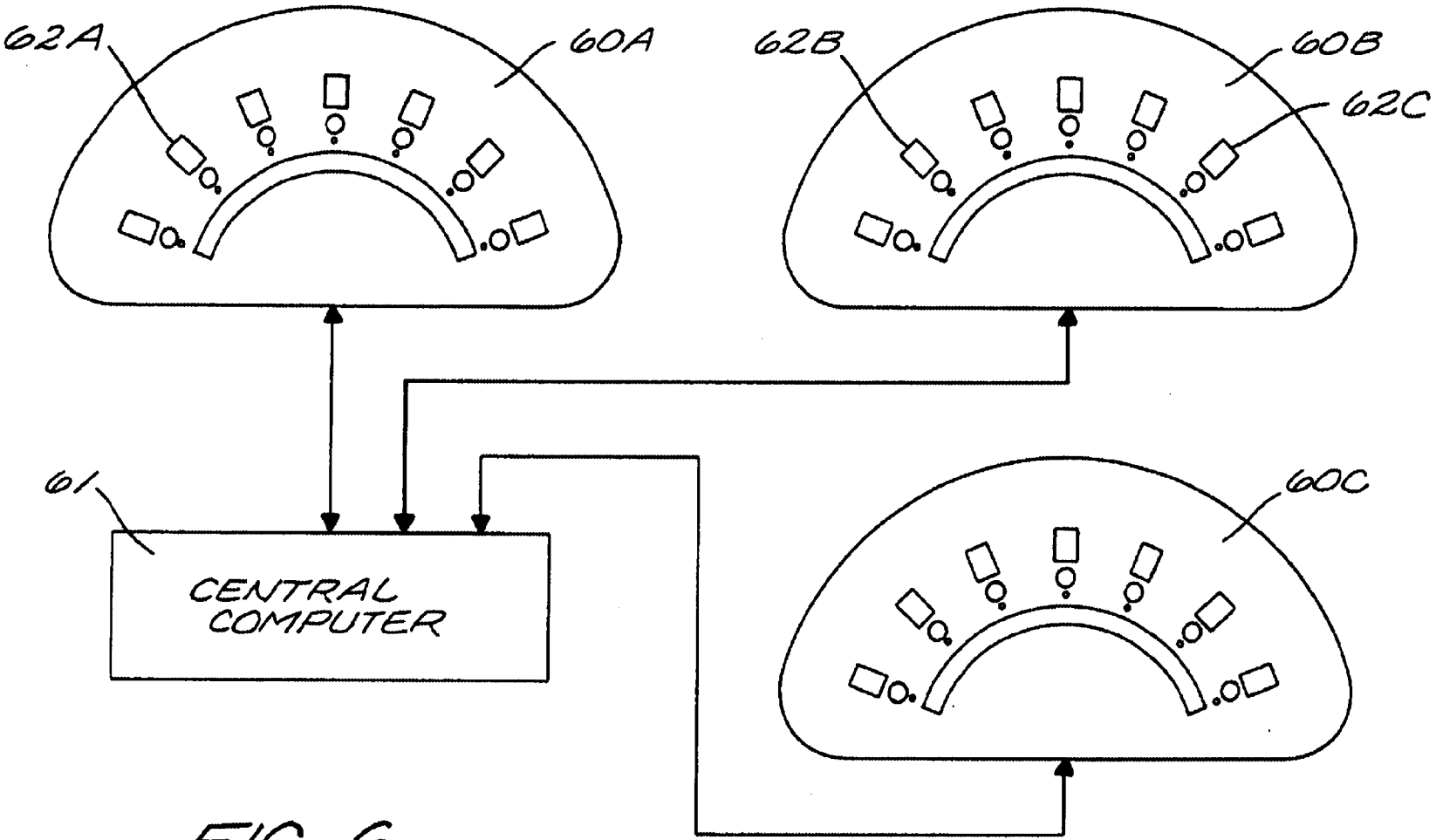

FIG. 6 diagrams a distributed gaming system utilizes multiple tables with a single central computer.

Figure 7A:
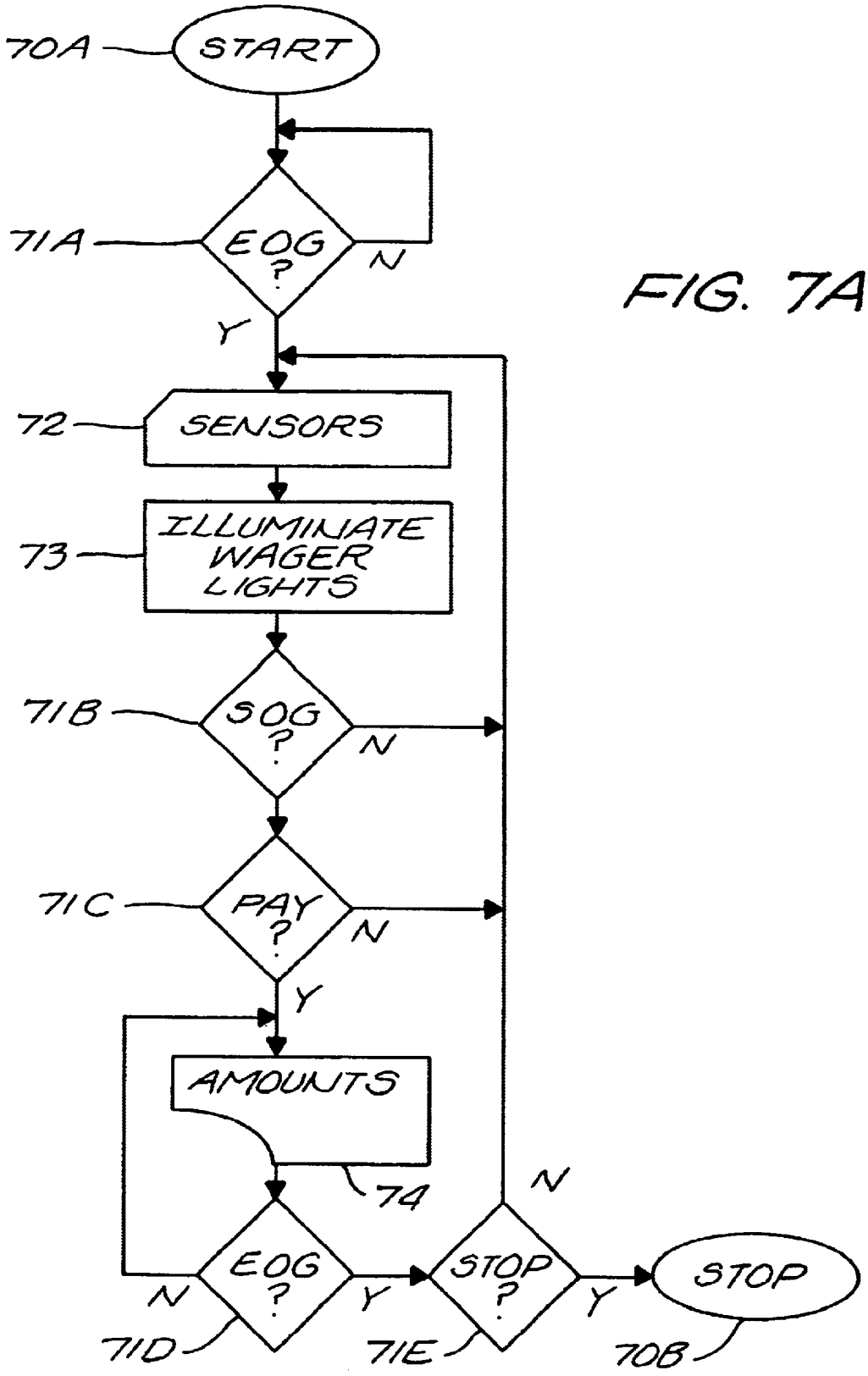
Figure 7B:
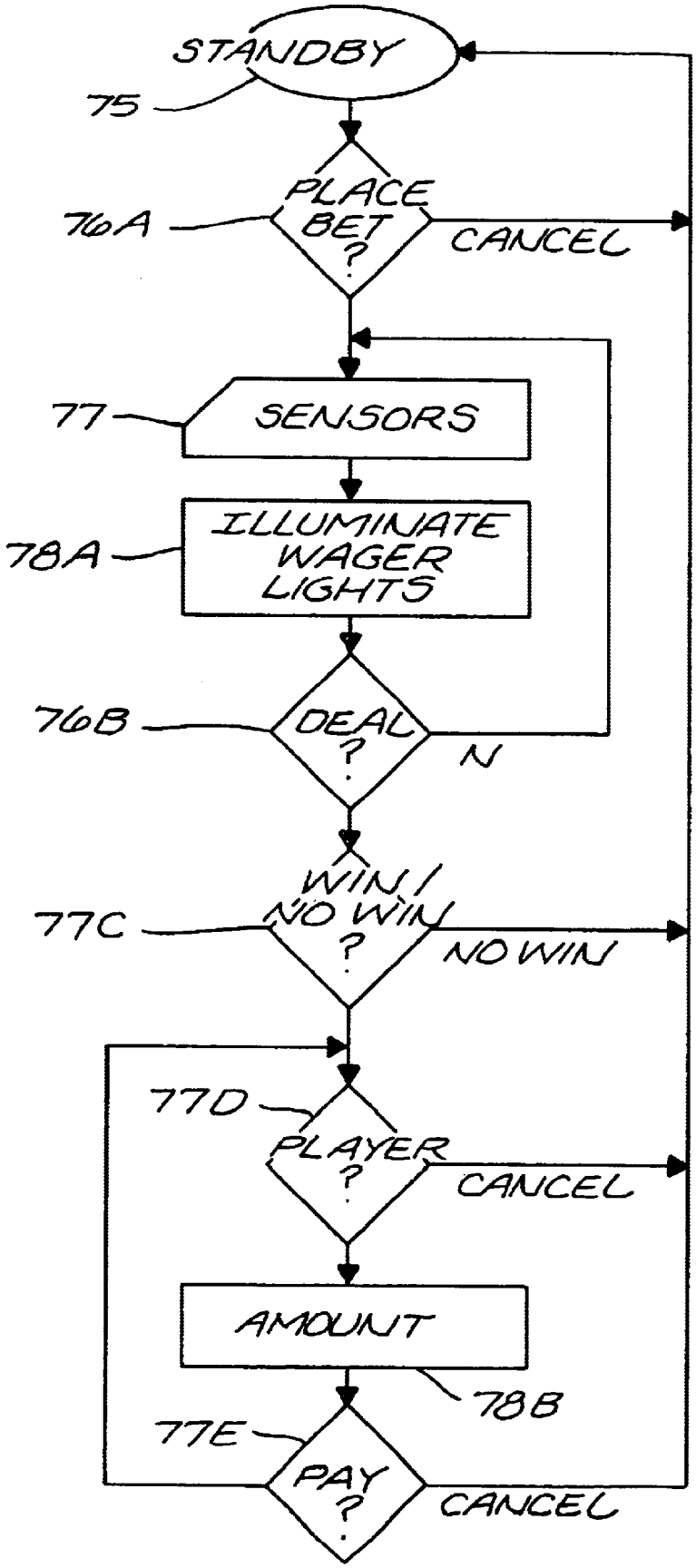

FIGS. 7A and 7B are flow-charts of the differing operations of the central computer in handling a single gaming table.

Figure 8A:
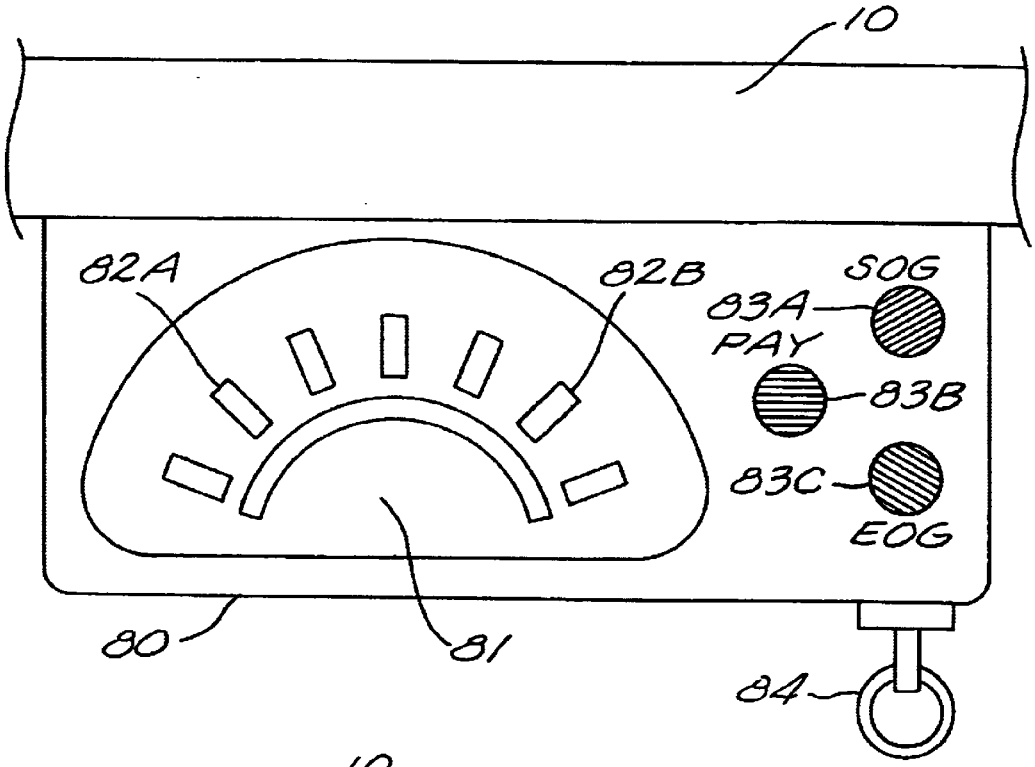
Figure 8B:
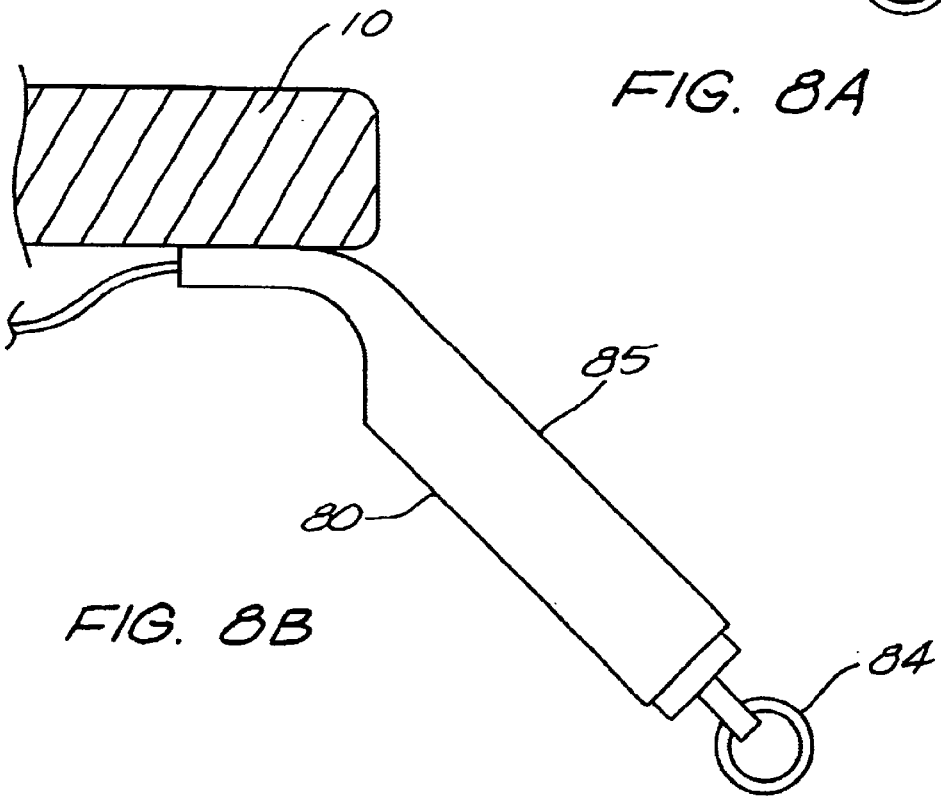

FIGS. 8A and 8B illustrate an alternative operator/dealer display panel.

DRAWINGS IN DETAIL

FIGS. 1A, 1B, 1C, and 1D are various views of the preferred gaming table of this invention.

This preferred gaming table has a flat surface 10 (table top) which is supported by legs 11A and 11B. Arrayed across the top of the flat surface 10, are player locations 13 which are addressed by operator/dealer position 15.

Each of the player locations has an imprint for the placement of cards 16 and an imprint for the placement of wagers 17. Further, in this embodiment, a wager light 14 is positioned to be associated with one of the wager imprints 17.

Mounted on an opposing second side of flat surface 10, are sensors 18. Each sensor is positioned beneath a single wager imprint 17. When a wager is placed on the wager imprint 17, it's mass is sensed by sensor 18; if the wager is recognized by the central computer (not shown in this illustration), then the wager light 14 associated with that player position is illuminated.

The status of the game, such as the payoff amounts, is communicated to the players and the operator/dealer via display 12.

Figure 1A:
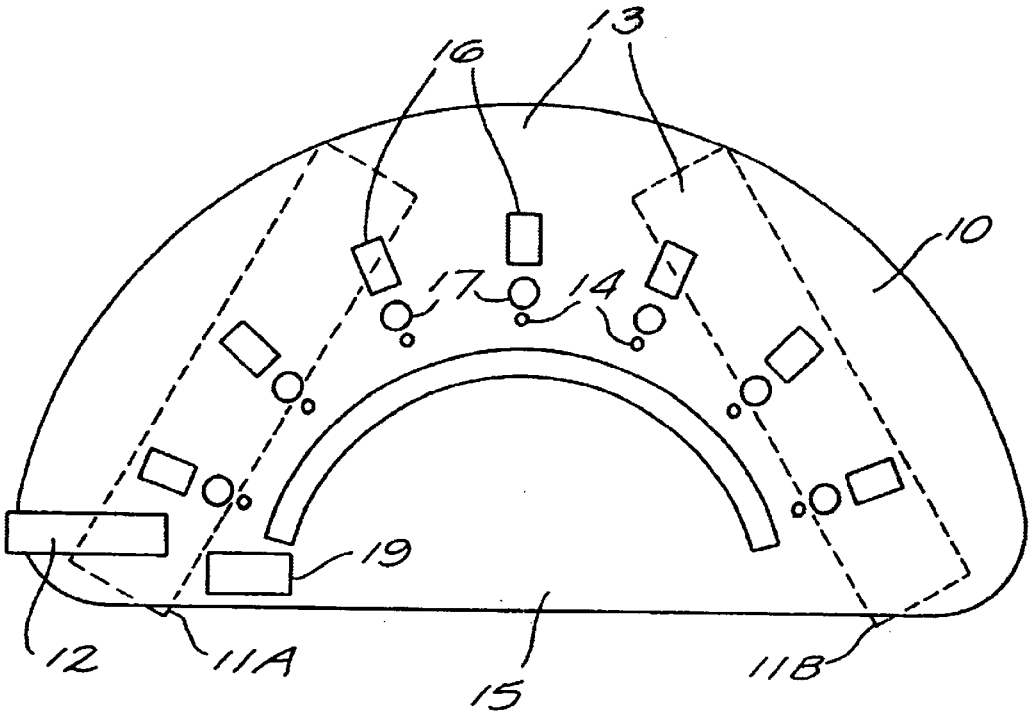
Figure 1B:
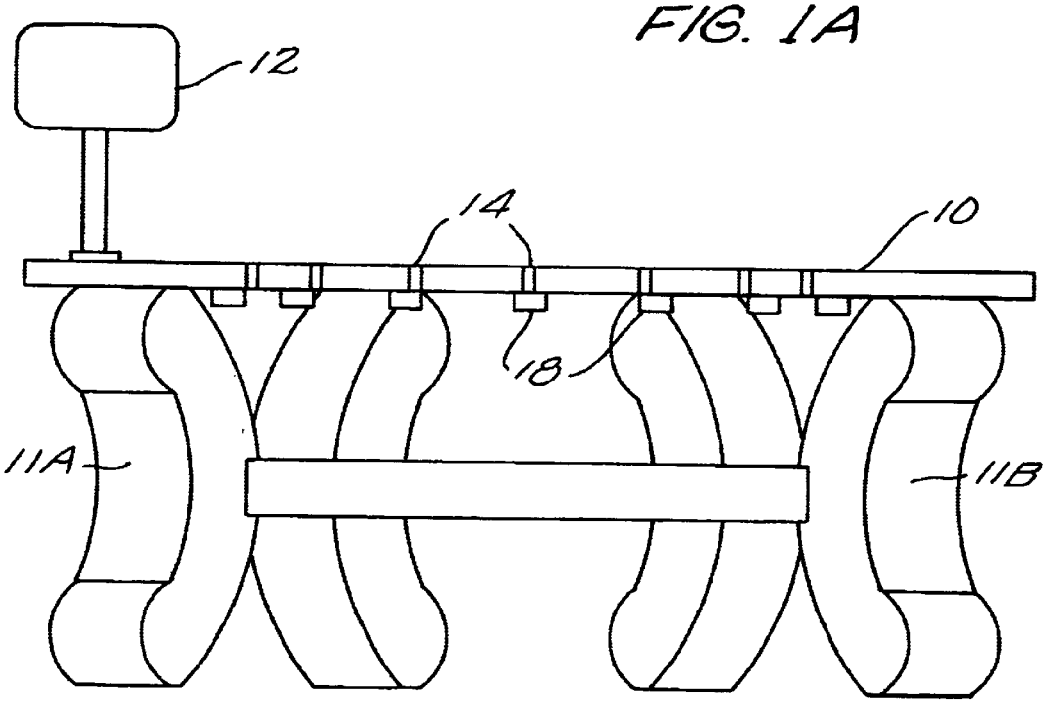
Figure 2:
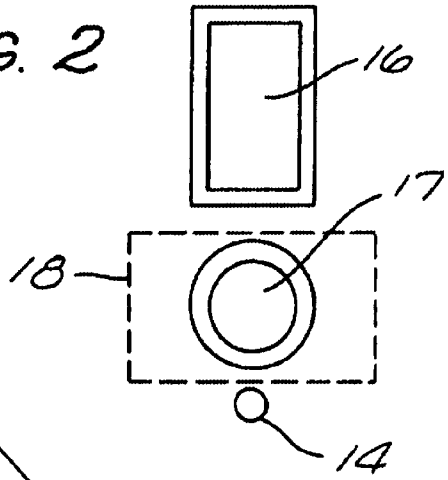
FIG. 2 is a close-up top view of a waging position.

FIG. 2 is a close-up top view of a waging position.

Each waging position has a card imprint 16 and a wager imprint 17. These items are merely imprints into the felt on the table. Located beneath wager imprint 17 is sensor 18 which monitors the mass above itself and communicates a signal (to the remote computer, not shown) indicating that a change in mass caused by the placement of chips has occurred.

The waging position also includes a wager light 14 which is illuminated only when: (1) a wager has been sensed; and, (2) the wager has been placed during the proper time of play. In many games, such as progressive bonus games, once the game has begun, the wager may not be entered; in other games, such as black-jack, in certain circumstances a "doubling up" of the bet after the cards have been dealt is permitted.

Figure 3:
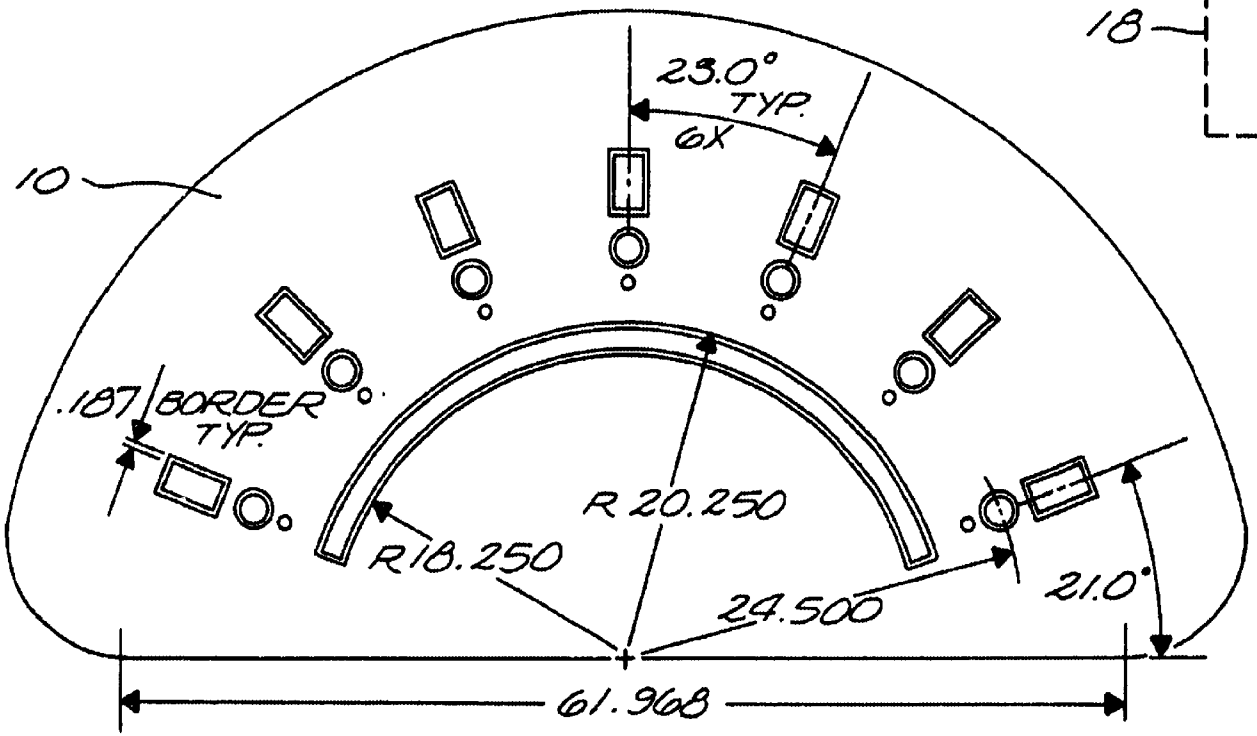
FIG. 3 is a top view of the preferred gaming table showing the preferred distance relationships between the markings.

FIG. 3 is a top view of the preferred gaming table showing the preferred distance relationships between the markings.

This table 10 has seven gaming positions positioned on it as indicated. The distances and arrangements are as indicated for this embodiment. Those of ordinary skill in the art readily recognize that other arrangements are also acceptable for this invention. There is no limit on the number of player positions or sensors per position.

Figure 4:
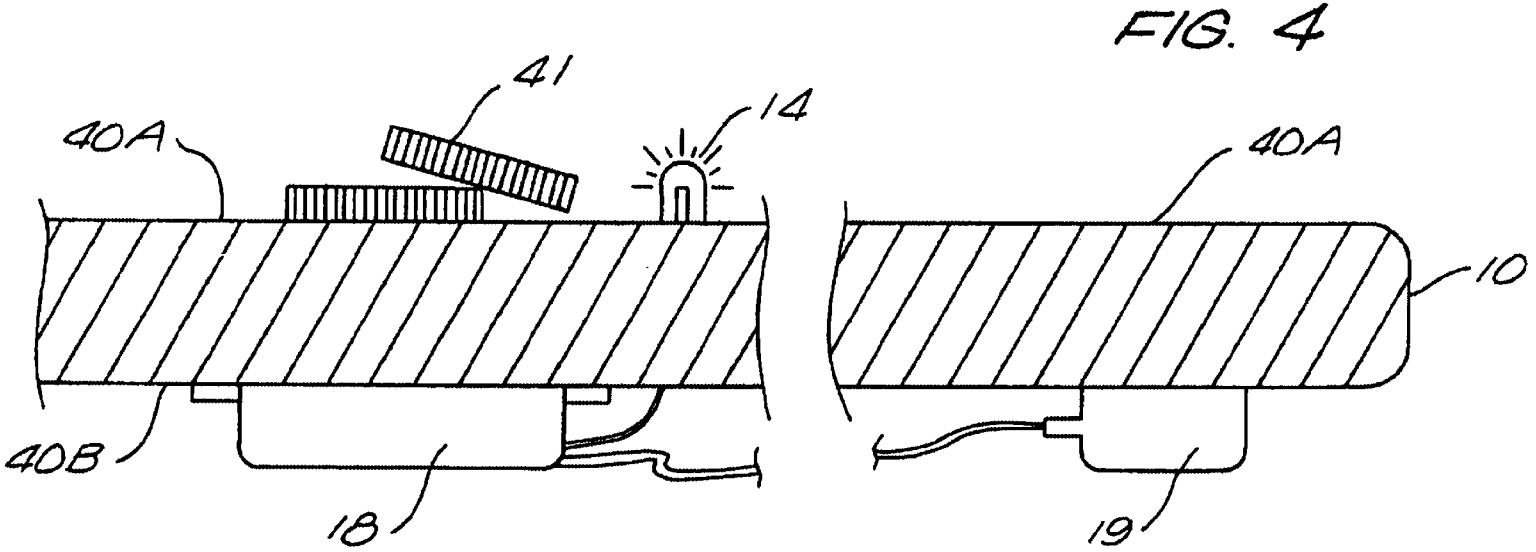
FIG. 4 is a side view of an embodiment of the invention illustrating the sensor with table connector.

FIG. 4 is a side view of an embodiment of the invention illustrating the sensor with table connector.

Table 10 has an upper surface 40A and a lower surface 40B. This illustration shows a single waging location. Chips 41 are placed on a wager imprint (not visible from this angle). The added mass of chips 41 is sensed by sensor 18 which communicates the occurrence to a remote computer (not shown) via connector 42A and 42B.

If chips 41 are bet at the appropriate point in play, then the remote computer directs the microprocessor within sensor 18 to illuminate wager light 14; otherwise, when wager light 14 is not illuminated, the player is informed that the wager has not been accepted.

Note, sensor 18 does not physically disturbed surface 40A in any manner. In one embodiment of the invention, the sensors are added to existing tables without any visual modification to the tables whatsoever (i.e. the sensors are all hidden from view under the tables). In this retro-fit situation, often wager lights 14 are not utilized.

Figure 5:
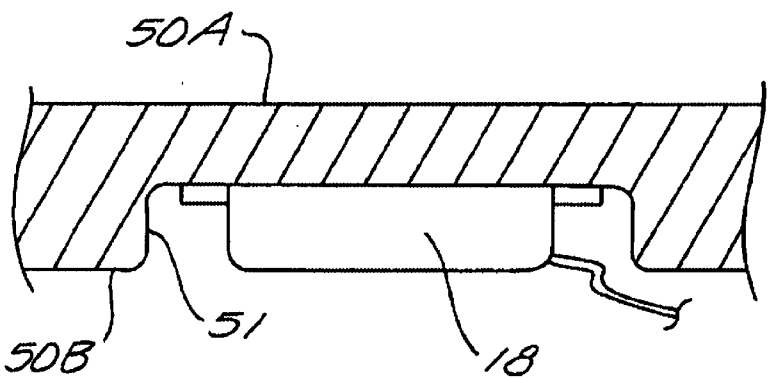
FIG. 5 is a side view of an embodiment of the invention showing the recesses used to position the sensors closer to the top of the gaming table.

FIG. 5 is a side view of an embodiment of the invention showing the recesses used to position the sensors closer to the top of the gaming table to increase the sensor's sensitivity.

In some situations, the thickness of table 10A exceeds the range with which the sensor is able to clearly identify when a wager has been placed on surface 50A. In this case, recesses 51 are formed in the underside 50B of table 10A allowing sensors 18 to be mounted closer to surface 50A.

This technique allows the placement of sensors on extremely thick tables without the need to disturbed the upper surface 50A in any way.

FIG. 6 diagrams a distributed gaming system utilizes multiple tables with a single central computer.

In this illustration, three gaming tables 60A, 60B, and 60C are connected to a central computer 61 for sharing common jackpots. The invention is not limited to three tables and can include any number of tables.

Each table has player positions which are equipped as outlined above with wager sensors. These sensors, together with operator/dealer input, are controlled by the table computer which communicates with the central computer which tracks the placement of wagers for wagers that are common to all tables.

As example, assume table 60A has begun dealing (as signified by an operator/dealer input), then a wager placed on position 62A will not be accepted and the associated wager light will not be illuminated. Meanwhile, table 50B has not begun the game and wagers are still being accepted, in this case, players at positions 62B and 62C are notified that their wagers have been accepted when their wager lights are illuminated.

The number of tables monitored by a single computer is determined by the computer's size/speed as well as the complexity of the games being plaid. In the preferred embodiment, a single computer monitors play at seven tables.

FIGS. 7A and 7B are flow-charts of the differing operations of the central computer in handling a single gaming table.

FIG. 7A is a flow-chart of the operation of the central computer in handling a single gaming table.

Once the system has been started 70A, the software determines if an End-Of-Game (EOG) signal has been received 71A from the operator/dealer panel. This query in continued until the EOG signal is received. At this point the input from the sensors 72 is collected and the proper wager lights are illuminated 73.

This process continues until the Start-Of-Game (SOG) 71B when the system then checks to see if the operator/dealer input indicates that a payment should be made 71C. If payment is not to be made (this also signifies an EOG signal), then the program again monitors the sensors for wagers 72.

If payment is to be made 71C, the amounts are displayed 74, and the system maintains displaying the amounts 74 until an EOG 71D is received.

At this point, the operator/dealer is able to stop play 71E which results in the system terminating 70B; or, continue with play with the sensors again being monitored 72.

While this flow-chart illustrates the preferred controlling sequence for the game, the flow and control changes with differing games and the objectives of the casino.

Referencing now FIG. 7B, a flow-chart of the preferred operation of the table computer during gameplay, once the system has been started and is in "standby mode" 75, the software determines if a Place Bet signal has been received 76A from the operator/dealer panel. Sensors are queried 77 as to whether there is a wager placed in the predetermined betting area for each player. If a wager is present, then an associated wager light is illuminated 78A. This query is continued until the Deal signal is received 76B. At this point, the sensors are not longer active.

The game is dealt and if there is not a winning combination, then No Win 75 ends the games and the program goes to Standby 75. If there is a winning combination and if a player wager light is lit indicating that the player has bet on this combination, the player becomes eligible 76. Depending on the winning combination that the eligible player has matched, the operator/dealer is notified 78B of the amount to be paid. Confirmation of the payment 78 is received, indicating an "End-of-Game".

FIGS. 8A and 8B illustrate an alternative operator/dealer display and control panel.

Display/control panel 80 is secured to the edge of table 10 near the dealer position. Panel 80 is activated by key 84 which is removed whenever the dealer leaves the table.

On a front surface 85 of panel 80, is a stylized table 81 having lights associated with each of the player positions. When a payment is to be made to a player, lights at the player position (such as lights 82A and 82B) are illuminated for the operator/dealer's reference.

The operator/dealer is also able to signal the central computer (not shown) of the status of the game by depressing switch 83A (Start Of Game), switch 83B (Pay Winners), or switch 83C (End of Game).

It is clear that the present invention provides a highly improved wager sensing mechanism and automatic process to facilitate the monitoring of wagers.

What is claimed is:

1. A wager sensing system comprising:

a) an opaque playing table having a first surface with an identified wager location for the placement of a wager, said first surface being uninterrupted at said identified wager location;

b) a sensor mounted to said opaque playing table on an opposing second side opposite said wager location, said sensor generating a wager signal indicative of a density of a wager on said wager location; and, c) a computer receiving said wager signal, said computer having means for notifying an operator of an existence of said wager signal.

2. The wager sensing system according to claim 1, wherein said wager signal is indicative of a mass of said wager at said wager location.

3. The wager sensing system according to claim 2, a) further including an operator activated switch generating a start-of-game signal; and, b) wherein said computer ignores said wager signal after receipt of said start-of-game signal.

4. The wager sensing system according to claim 3, a) further including a wager light positioned proximate to said wager location; and, b) wherein said computer includes means for activating said wager light in response to said wager signal.

5. The wager sensing system according to claim 4, a) wherein said operator activated switch includes means for generating an end-of-game signal; and, b) wherein said computer responds to said wager signal after receipt of said end-of-game signal.

6. The wager sensing system according to claim 1, wherein said opposing side includes a recess adapted to accept said sensor therein.

7. The wager sensing system according to claim 1, wherein a width of said opaque playing table is substantially uniform throughout said opaque playing table.

8. A wager sensor comprising:

a) a mass sensor mounted to a bottom surface of a playing table juxtaposed to awager location, said playing table having a uniform solid thickness at said wager location, said mass sensor generating a signal indicative of a mass above said mass sensor; and, b) a computer receiving said signal from said mass sensor.

9. The gaming system according to claim 8, a) further including an operator activated switch generating a start-of-game signal; and, b) wherein said computer ignores said wager signal from sensors at a playing table after receipt of said start-of-game signal.

10. The wager sensor according to claim 9, further including a visual display controlled by said computer.

11. The wager sensor according to claim 10, a) further including a wager lights positioned proximate to a single wager location on an upper surface of said playing table; and, b) wherein said computer includes means for activating said wager light in response to said signal from said mass sensor.

12. A game table comprising:

a) a playing table of substantially uniform thickness, said playing table having an upper surface with N wager locations thereon; and, b) N sensors, each of said N sensors mounted to said playing table on a bottom surface of said playing table, each of said N sensors positioned opposite a single wager location and generating electronic signals indicative of a mass above said sensor.

13. The game table according to claim 12, wherein the upper proximate to each of said wager locations is undisturbed and opaque.

14. The game table according to claim 13, further including N wager lights, each of said N wager lights positioned proximate to one of said N wager locations, said N wager lights being selectively activated.

* * * * *